US007896664B1

(12) United States Patent
Chou et al.

(10) Patent No.: US 7,896,664 B1
(45) Date of Patent: Mar. 1, 2011

(54) ARTICULATED LEVER MECHANISM FOR RETRACTABLE THUMB DRIVE

(75) Inventors: Peter Lee Kuo Chou, Orange, CA (US); Shing Kuo Tam, Cerritos, CA (US); John Pei Ho, Trabuco Canyon, CA (US)

(73) Assignee: Kingston Digital, Inc., Fountain Valley, CA (US)

( * ) Notice: Subject to any disclaimer, the term of this patent is extended or adjusted under 35 U.S.C. 154(b) by 0 days.

(21) Appl. No.: 12/800,301

(22) Filed: May 11, 2010

(51) Int. Cl.
*H01R 13/44* (2006.01)

(52) U.S. Cl. ..... 439/131

(58) Field of Classification Search ..... 439/131, 439/135, 142
See application file for complete search history.

(56) References Cited

U.S. PATENT DOCUMENTS 2,323,060 A * 6/1943 Larsson ..... 213/1.3
5,754,397 A * 5/1998 Howell et al. ..... 361/679.44
5,755,582 A * 5/1998 Charlton ..... 439/131
6,536,955 B2 * 3/2003 Ohbayashi et al. ..... 385/78
7,004,780 B1 * 2/2006 Wang ..... 439/353
7,535,719 B2 * 5/2009 Hiew et al. ..... 361/737
7,778,037 B2 * 8/2010 Huang ..... 361/752
7,811,101 B2 * 10/2010 Tang et al. ..... 439/131
2009/0042433 A1 * 2/2009 Bushby ..... 439/352
2009/0275224 A1 * 11/2009 Ni et al. ..... 439/131
2010/0110634 A1 * 5/2010 Woodbury et al. ..... 361/698
2010/0248512 A1 * 9/2010 Hiew et al. ..... 439/142

* cited by examiner

*Primary Examiner*—Briggitte R Hammond
*Assistant Examiner*—Larisa Z Tsukerman
(74) *Attorney, Agent, or Firm*—Duncan Palmatier

(57) ABSTRACT

A mechanism for extending and retracting the electrical connector in a flash memory thumb drive is disclosed. The flash memory and USB connector are disposed on a printed circuit board. The board is slidably disposed within a housing so that the connector can be extended beyond and retracted within the housing. An arm on a pivot can be rotated in one direction so that another lever extends the board, and rotated in the opposite direction to retract it.

20 Claims, 4 Drawing Sheets

ARTICULATED LEVER MECHANISM FOR RETRACTABLE THUMB DRIVE

FIELD OF THE INVENTION

The present invention relates to a mechanism to extend and retract a thumb drive's connector.

BACKGROUND OF THE INVENTION

A number of mechanisms have been devised for protecting a USB connector in a thumb drive memory device. As discussed in U.S. Pat. No. 6,808,400 to Tu, the prior art solution used a removable cap that snapped over the USB connector. See Tu, at column 1, lines 30 through 40, and FIG. 1 ("Prior Art"). The Tu patent discloses a USB connector at the end of a printed circuit board ("PCB") slidably disposed within a case. In one embodiment, a spring urges the PCB toward a position in which the USB connector extends beyond the case, and a "pushing button" with an arm having a "buckling piece" holds the PCB in a retracted position. Another embodiment disclosed in Tu reverses the spring and buckle arrangement to hold the PCB and USB connector in the extended position. Other embodiments of TU use a lipstick-style mechanism. The lipstick-style mechanism relies on a rotating knob that turns a threaded shaft which screws into a threaded bore connected to the PCB. When the knob is turned, the shaft causes the PCB to extend or retract.

A button mechanism is disclosed in U.S. Pat. No. 7,422,454 to Tang et al., relying on a "middle carrier" that is located within halves of a casing, whereby the carrier can be moved within the case, thereby extending or retracting a USB connector.

The present retractable thumb drive mechanisms relying on a button to extend and retract the USB connector provide no mechanical advantage. The lipstick-style mechanism provides some mechanical advantage, but requires two hands to operate and usually requires too many turns.

SUMMARY OF INVENTION

The present invention provides a retractable USB thumb drive mechanism that offers mechanical advantage for extending and retracting the USB connector. The present invention also provides a mechanism that can operated with one hand.

DETAILED DESCRIPTION OF SPECIFIC EMBODIMENTS

Figure 1:
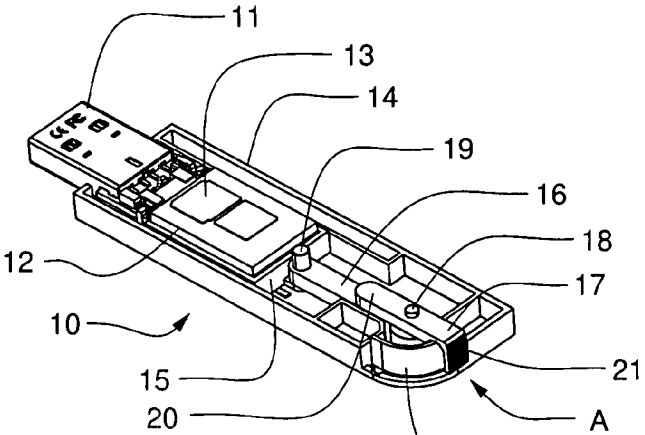
FIG. 1 is a three-quarter, cut-away view of the thumb drive mechanism of the present invention, showing the connector in the extended position.
Figure 2:
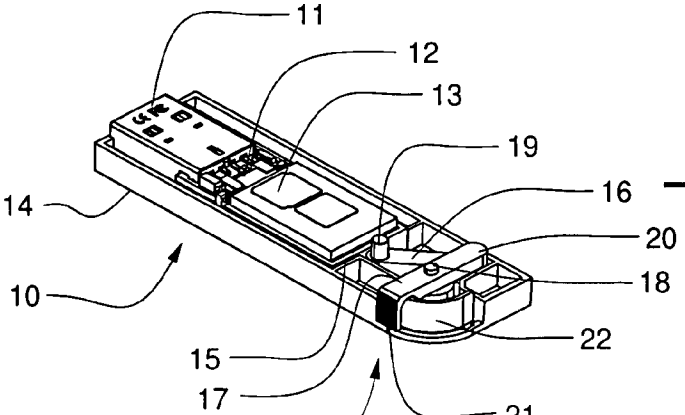
FIG. 2 is a three-quarter, cut-away view of the thumb drive mechanism of the present invention, showing the connector in the retracted position.

FIG. 1 shows a flash memory thumb drive 10 with the USB connector 11 in the extended position. In the embodiment shown in FIG. 1, the USB connector 11 is electrically connected to the memory device 13, which together form a support structure 12. The USB connector 11 and the memory device 13 may be mounted on a printed circuit board assembly ("PCBA") and together form the support structure 12. It is not necessary that the USB connector 11 and memory device 13 be fixed on a PCBA to form a unitary structure, but, if the memory device 13 is separate from the support structure 12, then alternative electrical connections between the connector 11 and the memory device 13 must be provided. Persons in the art will appreciate that such connections can be provided by wires, contact strips, or other arrangements. The support structure 12 is mounted in a carriage 15 which is slidably received between the bottom 14 and top 25 (shown in FIG. 3) halves of the complete flash memory thumb drive 10 casing. The USB connector 11 is at one end of the support structure 12. The opposite end (where the line for reference number "15" is directed in the drawings) of the carriage 15 is connected by a shaft 19 to a first lever 16. First lever 16 is pivotably connected at a pivot end 20 to the proximal end of an operating lever 17. Operating lever 17 pivots on a shaft 18 located in the middle of the lever 17. The distal end of the operating lever 17 is the operating end 21 of the mechanism. The operating end 21 of the operating lever 17 swivels about a 90-degree arced wall 22 from position A to position B (as shown in FIG. 2). In position A, operating lever 17 and first lever 16 are aligned from end 21 to end 19, so that the support structure 12 is extended to its maximum travel and the USB connector 11 extends out of the casing of the thumb drive 10. When operating end 21 is moved to position B, as shown in FIG. 2, operating lever 17 swivels about pivot shaft 18 and comes to a stop at a right angle to the length of the thumb drive 10. In position B, the first lever 16 is pulled by the pivot end 20 and the shaft 19 in turn pulls the carriage 15 into a retracted position, which brings the USB connector 11 within the casing of the thumb drive 10.

Figure 3:
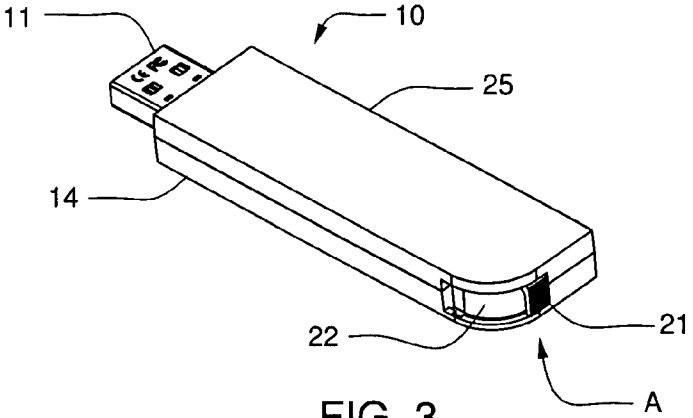
FIG. 3 is a three-quarter, exterior view of the thumb drive mechanism of the present invention, showing the operating button of the operating lever in the extended position.
Figure 4:
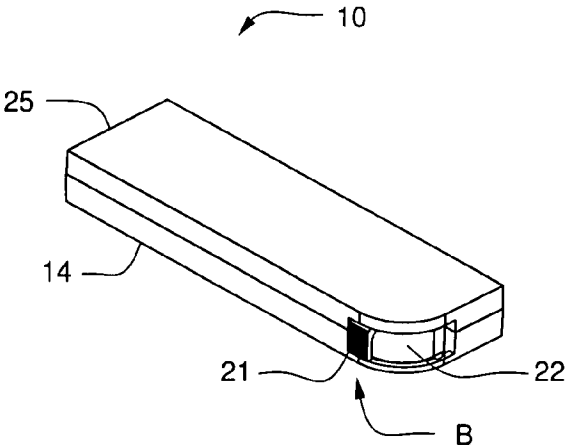
FIG. 4 is a three-quarter, exterior view of the thumb drive mechanism of the present invention, showing the operating button of the operating lever in the retracted position.

FIGS. 3 and 4 show the thumb drive 10 with the top half 25 of the casing in place. In FIG. 3, the operating end 21 of the operating lever 17 (not seen in FIG. 3), is in position A on the arced wall 22, so that the USB connector 11 is extended out of the thumb drive 10 casing. In FIG. 4, the operating end 21 of the operating lever 17 (not seen in FIG. 4), is in position B on the arced wall 22, so that the USB connector 11 (not seen in FIG. 4) is retracted within the thumb drive 10 casing.

Figure 5:
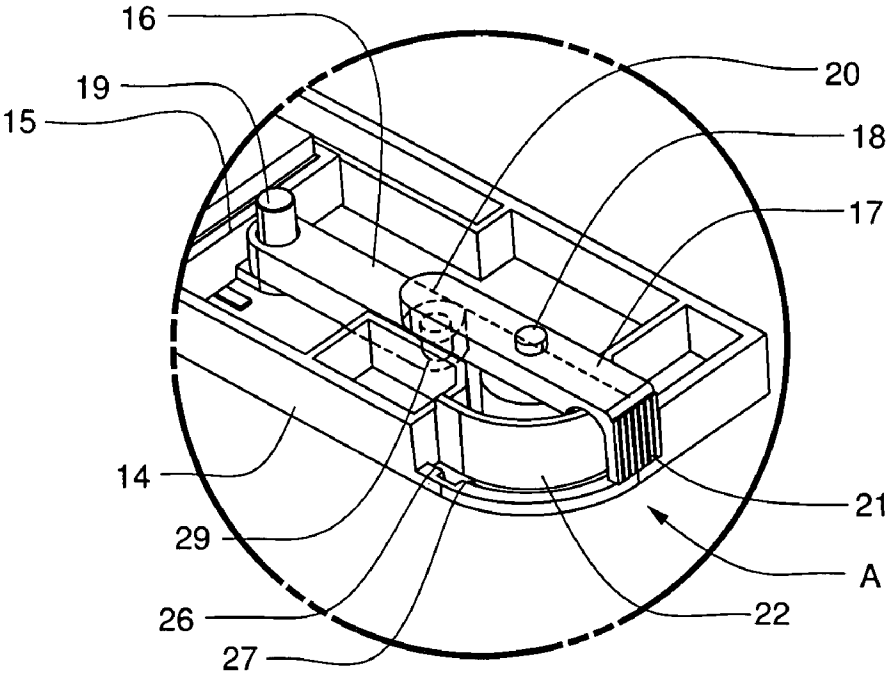
FIG. 5 is a three-quarter, detailed view of the lever mechanism of one embodiment of the invention, showing the mechanism in a fully extended position.
Figure 6:
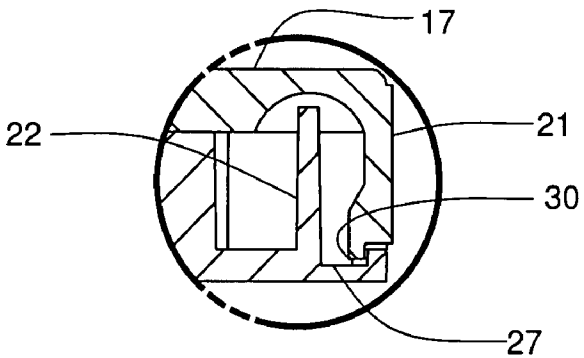
FIG. 6 is a detail view of the lever mechanism of one embodiment of the invention.
Figure 7:
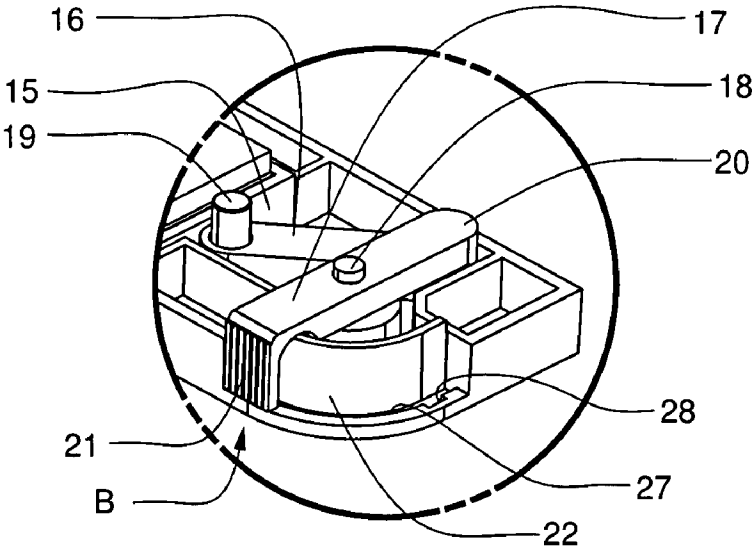
FIG. 7 is a three-quarter, detailed view of the lever mechanism of one embodiment of the invention, showing the mechanism in a fully retracted position.

FIGS. 5 through 7 provide detail of the lever mechanisms. FIG. 5 shows the mechanism in position A, which pushes the carriage 15 forward to extend the USB connector 11 out of the thumb drive 10 casing (as shown in FIG. 1). The opposite end of the carriage 15 has the shaft 19 to which the first lever 16 is pivotably connected. When first lever 16 is pushed or pulled by the operating lever 17, shaft 19 pushes or pulls the carriage 15. At the pivot end 20, the first lever 16 is pivotably connected to the operating lever 17 by a shaft 29. Operating lever 17 pivots on a rocker shaft 18. At the distal end of the operating lever 17 is the operating end 21, which can have a grooved surface (as shown), to provide more grip to the user. FIG. 5 shows the operating end 21 in position A, where the operating lever 17 and first lever 16 are aligned and the carriage 15 is pushed to its extended position. FIG. 5 provides detail of the operating end 21 of the operating lever 17 in position A and FIG. 7 shows it in position B. FIG. 6 is a detail, cross section view of the operating end 21 of the operating lever 17. At the base of wall 22 is a channel 27 into which a guide portion 30 of the operating end 21 is trapped. Guide portion 30 extends down below the bottom of operating end 21 into channel 27. At positions A and B, indents 28 and 26 (as shown in FIGS. 6 and 7) provide a notch into which the guide portion 30 is releaseably latched. Operating end 21 is flexible, so that when the user pushes on the operating end 21, the guide portion 30 is released from the indent (28 or 26) and the operating lever 17 can be swivelled about the arced wall 22.

Figure 8:
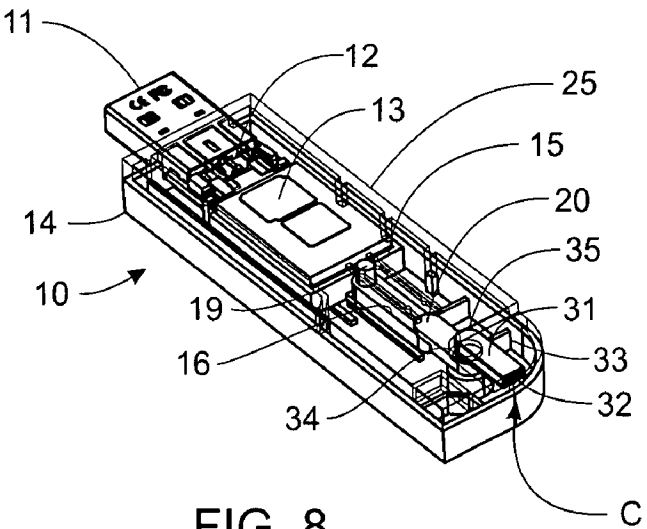
FIG. 8 is a three-quarter, cut-away view of an alternative embodiment of a thumb drive mechanism of the present invention, showing the connector in the extended position.
Figure 9:
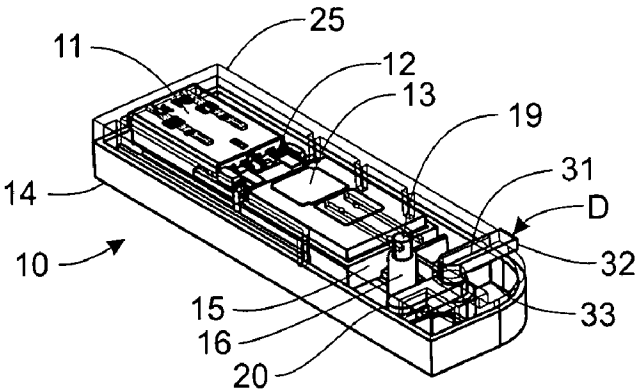
FIG. 9 is a three-quarter, cut-away view of an alternative embodiment of a thumb drive mechanism of the present invention, showing the connector in the retracted position.

FIGS. 8 through 12 show alternate embodiments of the present invention. FIGS. 8 and 9 show the thumb drive 10 with the top half of the casing 25 in ghost, so that the mechanism may be seen as it rests on the bottom half of the casing 14. The opposite end of the carriage 15 is connected by shaft 19 to first lever 16. The operating lever 17, described above, is divided into two portions, a proximal portion 34 and a distal portion 31. First lever 16 is pivotably connected at pivot end 20 to the proximal portion 34. The proximal 34 and distal 31 portions form a lever that pivots 35 in the middle. The distal portion 31 is the operating end 32 of the mechanism. The operating end 32 swivels 90-degrees on an arced surface 33 from position C to position D (as shown in FIG. 9). In position C, the proximal 34 and distal 31 portions of the lever are aligned with lever 16 from end 32 to end 19, so that the carriage 15 is extended to its maximum travel and the USB connector 11 extends out of the casing of the thumb drive 10. When operating end 32 is moved to position D, as shown in FIG. 9, distal portion 31 swivels about pivot shaft 35 and comes to a stop at a right angle to the length of the thumb drive 10. In position D, the first lever 16 is pulled by the pivot end 20 and the shaft 19 in turn pulls the carriage 15 into a retracted position, which brings the USB connector 11 within the casing of the thumb drive 10.

Figure 10:
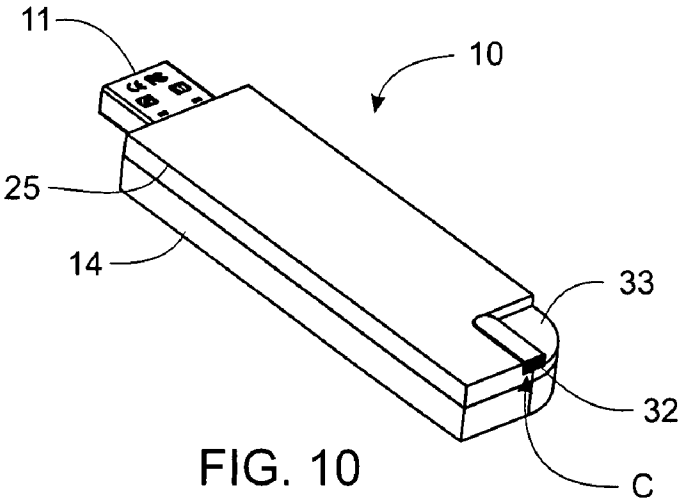
FIG. 10 is a three-quarter, exterior view of an alternative embodiment of a thumb drive mechanism of the present invention, showing the operating lever in the extended position.
Figure 11:
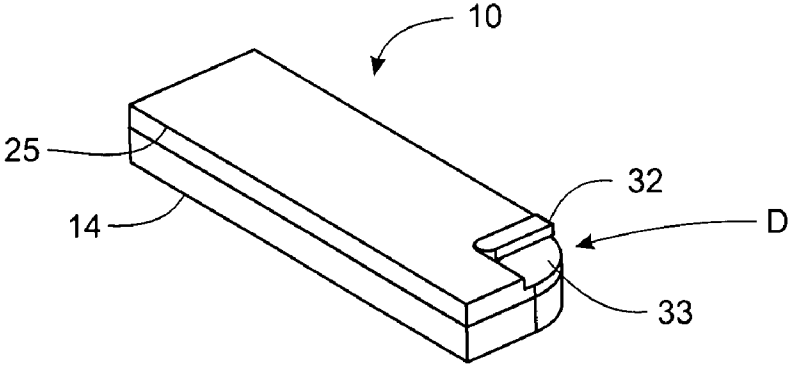
FIG. 11 is a three-quarter, exterior view of an alternative embodiment of a thumb drive mechanism of the present invention, showing the operating lever in the retracted position.

FIGS. 10 and 11 show the thumb drive 10 with the top half 25 of the casing in place. In FIG. 10, the operating end 32 of the distal portion 31 (shown in FIG. 8), is in position C on the arced surface 33, so that the USB connector 11 is extended out of the thumb drive 10 casing. In FIG. 11, the operating end 32 of the distal portion 31 (shown in FIG. 9), is in position D on the arced surface 33, so that the USB connector 11 (shown in FIG. 9) is retracted within the thumb drive 10 casing.

Figure 12:
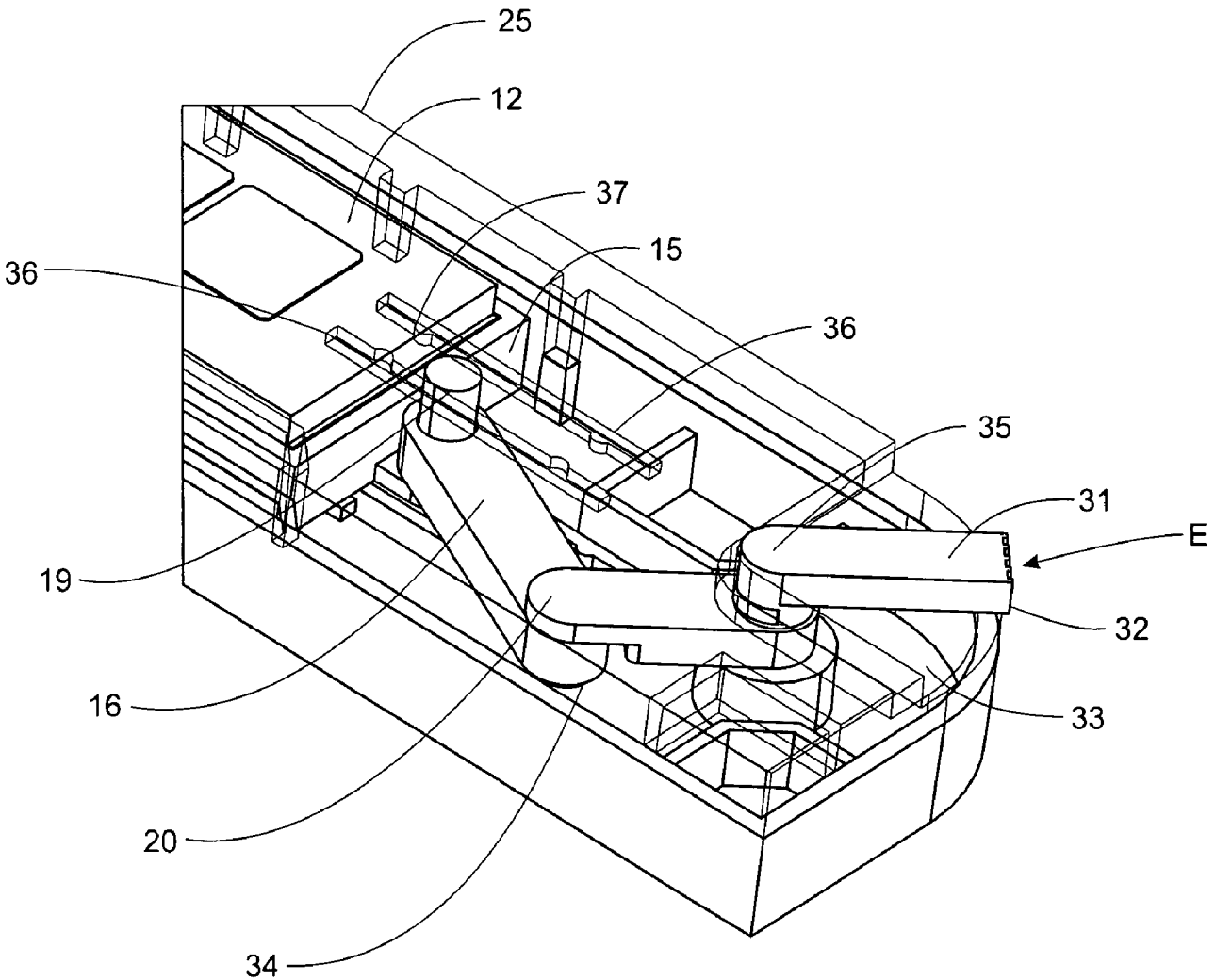
FIG. 12 is a three-quarter, detailed view of the lever mechanism of an alternate embodiment of the present invention, showing the mechanism in a partially extended position.

FIG. 12 provides a closer detail view of the lever mechanism shown in FIGS. 8 through 11. In FIG. 12, the top half 25 of the casing of the thumb drive 10 is drawn in ghost to reveal the latching mechanism described below. The opposite end of the carriage 15 has the shaft 19 to which the first lever 16 is pivotably connected. When first lever 16 is pushed or pulled by operating lever 17, shaft 19 pushes or pulls the carriage 15. At the pivot end 20, the first lever 16 is pivotably connected to the proximal portion 34 at 20. Distal portion 31 pivots at 35. Proximal portion 34 is located under the top casing 25, but distal portion 31 is located outside the top casing 25 on the arced surface 33. The proximal 34 and distal 31 portions of the lever are joined at the pivot 35. Thus, the distal portion 31 operates as an arcing lever. FIG. 12 shows the operating end 32 in position C, mid-way between the fully extended (C) and fully retracted (D) positions.

FIG. 12 also shows an alternative latching mechanism to hold the carriage 15 in the extended (C) or retracted (D) positions. The shaft 19 extends upward and is trapped by a pair of downwardly directed guide rails 36 formed as part of the inner surface of top casing 25. The pair of guide rails 36 form a guide channel. Protrusions 37 in the guide rails 36 trap the shaft 19 when it is in the fully extended (C) or fully retracted (D) position. The shaft 19, top casing 25, guide rails 36, and protrusions 37 are made of deformable material, such as plastic, so that when shaft 19 is pushed by the lever mechanism against protrusions 37, the shaft 19 will overcome the resistance of the protrusions 37 and be forced past them. But, the protrusions 37 will provide enough resistance to hold the support structure 12 in the extended (C) or retracted (D) position.

The drawings and description set forth here represent only some embodiments of the invention. After considering these, skilled persons will understand that there are many ways to make a lever mechanism for a retractable thumb drive according to the principles disclosed. The inventors contemplate that the use of alternative structures, materials, or manufacturing techniques, which result in a lever mechanism for a retractable thumb drive according to the principles disclosed, will be within the scope of the invention.

I claim:

1. A retractable thumb drive device comprising:

a casing having an interior cavity, an exterior, and an opening, a memory storage unit disposed within the interior cavity of said casing, a connector electrically connected to said memory storage unit so that data stored in said memory storage unit may be transferred to and from said memory storage unit, and wherein said connector is configured to extend at least partially beyond the opening in the casing, a lever having an operating end, a joint end, and a pivot point therebetween, wherein the lever pivots on a fulcrum at the pivot point, and wherein at least the operating end of the lever is located at the exterior of said casing, a rod having a first end and a second end, wherein said first end of the rod is connected to the joint end of said lever, and wherein the second end of said rod is connected directly or indirectly to the connector, so that when the lever is pivoted about said fulcrum in one direction, the lever pushes against said rod and said rod pushes the connector through said opening in the casing to a position where at least a portion of the connector extends outside the casing, and so that when the lever is pivoted about said fulcrum in another direction, the lever pulls said rod and said rod pulls the connector through said opening in the casing to a position where substantially all of the connector is retracted within the interior cavity of said casing.

2. The retractable thumb drive device of claim 1 wherein the connector is a USB connector.

3. The retractable thumb drive device of claim 1 wherein the memory storage unit is part of a PCBA having circuitry to which said memory storage unit is electrically connected, and wherein the connector is electrically connected to said circuitry, and wherein the circuitry electrically connects said memory storage unit and said connector.

4. The retractable thumb drive device of claim 3 wherein the connector is fixed to said PCBA.

5. The retractable thumb drive device of claim 4 wherein the PCBA and memory storage unit and connector form a carriage having a connector end and a second end, and wherein the rod is connected to said second end.

6. The retractable thumb drive device of claim 5 wherein the second end is at an opposite end of said PCBA from said connector end.

7. The retractable thumb drive device of claim 5 wherein the rod is pivotably connected to the second end of said carriage by a pin.

8. The retractable thumb drive device of claim 1 wherein the operating end of said lever has a gripping surface.

9. The retractable thumb drive device of claim 1 wherein the casing further comprises an arced wall located on the exterior of said casing, and wherein the operating end of said lever pivots about said arced wall.

10. The retractable thumb drive device of claim 9 wherein the arced wall further comprises a base and a channel located at said base, and wherein the operating end of said lever further comprises a guide portion that is trapped in said channel.

11. The retractable thumb drive device of claim 10 wherein the channel further comprises at least one indent, and wherein the guide portion of the operating end of said lever further comprises a protrusion that is releaseably captured by said indent.

12. The retractable thumb drive device of claim 1 wherein the second end of said rod has a projection that is captured between a pair of guide rails, and wherein at least one of said guide rails further comprises at least one flexible protrusion extending in the direction of the other guide rail, so that the projection of the operating end of said lever is trapped in at least one position when the projection is forced past said flexible protrusion.

13. The retractable thumb drive device of claim 12 wherein the guide rails are formed as part of an interior surface of said casing.

14. An articulated lever mechanism for retracting and extending a USB thumb drive apparatus, comprising:

a memory storage system for storing electronic data, said memory storage system having a connector end and an articulated end, a USB connector electrically connected to the connector end of said memory storage system, a casing having an exterior and an interior, the interior of said casing configured to enclose said memory storage system and at least a portion of said USB connector when the USB is in a retracted position, said casing further comprising an opening configured to allow at least another portion of said USB connector to extend therethrough when said USB connector is in an extended position, a rod having a proximal end and a distal end, wherein said proximal end is connected to the articulated end of said memory storage system, an operating lever having a joining end and an operating end and a pivoting point, wherein said operating lever pivots about said pivoting point, and wherein said joining end is connected to the distal end of said rod, and wherein the joining end of said operating lever pulls the rod when the operating end of said operating lever is pivoted in one direction, thereby retracting said USB connector to said retracted position, and wherein the joining end of said operating lever pushes the rod when the operating end of said operating lever is pivoted in an opposite direction, thereby extending said USB connector to said extended position.

15. The articulated lever mechanism of claim 14, wherein the casing further comprises a latch to releaseably hold the rod in at least one of said extended or retracted positions.

16. The articulated lever mechanism of claim 15, wherein the latch comprises:

a guide channel formed on a surface of the interior of said casing, said guide channel further comprising a notch, and a guide portion at the proximal end of said rod, wherein the guide portion rides in and is captured by said guide channel, said guide portion further comprising a projection, wherein the projection of said guide portion is releaseably held in the notch of the channel when the operating lever is in the at least one of said extended or retracted positions.

17. The articulated lever mechanism of claim 14, wherein the articulated end of said memory storage system further comprises an extension, and wherein the interior of said casing further comprises a channel formed by at least two, opposite side walls in which said extension is captured, and wherein at least one of said side walls further comprises at least one flexible projection extending toward the opposite side wall, so that the extension is releaseably retained in one portion of said channel when said extension is pushed past said flexible projection.

18. The retractable thumb drive device of claim 14 wherein the proximal end of the rod is connected to the articulated end of said memory storage system by a pin.

19. The retractable thumb drive device of claim 14 wherein the operating end of said operating lever further comprises a gripping surface.

20. The retractable thumb drive device of claim 14, wherein the exterior of said casing further comprises an arced surface, and wherein the operating end of said operating lever pivots on said arced surface.

* * * * *

UNITED STATES PATENT AND TRADEMARK OFFICE

CERTIFICATE OF CORRECTION

PATENT NO. : 7,896,664 B1
APPLICATION NO. : 12/800301
DATED : March 1, 2011
INVENTOR(S) : Peter Lee Kuo Chou, Shing Kuo Tarn and John Pei Ho It is certified that error appears in the above-identified patent and that said Letters Patent is hereby corrected as shown below:

Title Page, item (75) "Inventors", the second inventor's name should be spelled as follows: --Shing Kuo TARN--.

Signed and Sealed this
Twelfth Day of July, 2011

David J. Kappos

David J. Kappos
*Director of the United States Patent and Trademark Office*